US005306191A

United States Patent [19]

Phillips et al.

[11] Patent Number: 5,306,191

[45] Date of Patent: Apr. 26, 1994

[54] CYLINDRICAL AERODYNAMIC TOY WITH BALLAST RINGS

[76] Inventors: Charles B. Phillips, 180 West End Avenue (18-L), New York, N.Y. 10023; Ronald A. Wiecek, 26430 127 St. SE., Monroe, Wash. 98272

[21] Appl. No.: 47,930

[22] Filed: Apr. 19, 1993

[51] Int. Cl.[5] ..... A63H 27/00; A63B 65/00

[52] U.S. Cl. ..... 446/61; 446/68; 273/428

[58] Field of Search ..... 442/61, 63, 64, 66, 442/65, 67, 68, 34, 15, 56, 46, 48; 273/428, 416, 419, 420, 423

[56] References Cited

U.S. PATENT DOCUMENTS

| | | | |
|---|---|---|---|
| 2,443,395 | 6/1948 | Lutins | 273/420 X |
| 2,599,957 | 6/1952 | Walker | 446/68 |
| 3,002,314 | 10/1961 | Brottman | 446/15 |
| 3,839,818 | 10/1974 | Heggedal | 446/68 X |
| 3,982,489 | 9/1976 | Flatau et al. | 273/425 X |
| 4,003,574 | 1/1977 | MacDonald et al. | 273/428 X |
| 4,502,692 | 3/1985 | Humphrey | 273/420 X |
| 4,790,788 | 12/1988 | Hill | 446/61 |
| 4,925,195 | 5/1990 | Di Manno | 273/428 |
| 5,067,922 | 11/1991 | McMahon | 446/61 X |
| 5,156,564 | 10/1992 | Hasegawa | 446/15 |
| 5,176,559 | 1/1993 | Lane | 446/61 X |

FOREIGN PATENT DOCUMENTS

| | | | |
|---|---|---|---|
| 016107 | 11/1992 | Australia | 446/61 |
| 516691 | 9/1956 | Italy | 446/64 |

*Primary Examiner*—David N. Muir
*Attorney, Agent, or Firm*—Charles E. Baxley

[57] ABSTRACT

A toy with aerodynamic properties includes a body member with a front end, a rear end and an inner cylindrical surface which is in communication with the front and rear ends. The outer surface of the body member has a generally cylindrical surface which is coaxial with the inner cylindrical surface and a plurality of circumferentially spaced wings. A pair of circumferential bands are disposed on the outer surface of the body member. The circumferential bands can be moved closer and further from the front end to adjust the balance of the toy and the aerodynamic flight properties.

9 Claims, 2 Drawing Sheets

CYLINDRICAL AERODYNAMIC TOY WITH BALLAST RINGS

BACKGROUND OF THE INVENTION

This invention relates generally to the field of toy apparatus and more particularly to a toy with aerodynamic properties which can be used both indoors and outdoors.

The prior art related to toys includes numerous well known examples of various types of balls which are used in games such as: baseball, football, tennis, racquet ball. During use, these balls are either thrown or struck with a variety of equipment including various types of racquets or bats. Each of these balls has a generally regular geometrical configuration with little or no aerodynamic properties. In addition, each of these balls has a relatively stiff or heavy construction which make them unsuitable for indoor play in other than specially designated play areas.

OBJECTS AND SUMMARY OF THE INVENTION

It is an object of the present invention to provide a toy with aerodynamic properties which can be used for both indoor and outdoor play.

Another object of the present invention is to provide a toy with aerodynamic properties which can be adjusted to create various flight characteristics.

Another object of the present invention is to provide a toy with aerodynamic properties which is relatively light in weight which facilitates use by people with a range of athletic capabilities including small children.

Another object of the present invention is to provide a toy with aerodynamic properties which has an outer surface which facilitates gripping and throwing.

Yet another object of the present invention is to provide a toy with aerodynamic properties which includes a relatively small number of simple component parts, each of which can be manufactured economically, resulting in a relatively low overall cost.

The foregoing and other objects and advantages of the invention will appear more clearly hereinafter.

In accordance with the present invention, there is provided a toy with aerodynamic properties which includes a body member with a front end, a rear end and an inner cylindrical surface which is in communication with the front and rear ends. The outer surface of the body member has a generally cylindrical surface which is coaxial with the inner cylindrical surface and a plurality of circumferentially spaced wings. The wings extend from the rear surface toward the front surface. A pair of circumferential bands are disposed on the outer surface of the body member between the wings and the front end. The circumferential bands enable the toy to be grasped easily and they can be moved closer and further from the front end in order to adjust the balance of the to and the aerodynamic flight properties.

DESCRIPTION OF THE DRAWINGS

Other important objects and advantages of the invention will be apparent from the following detailed description taken in conjunction with the accompanying drawings in which.

DETAILED DESCRIPTION OF THE INVENTION

Figure 1:
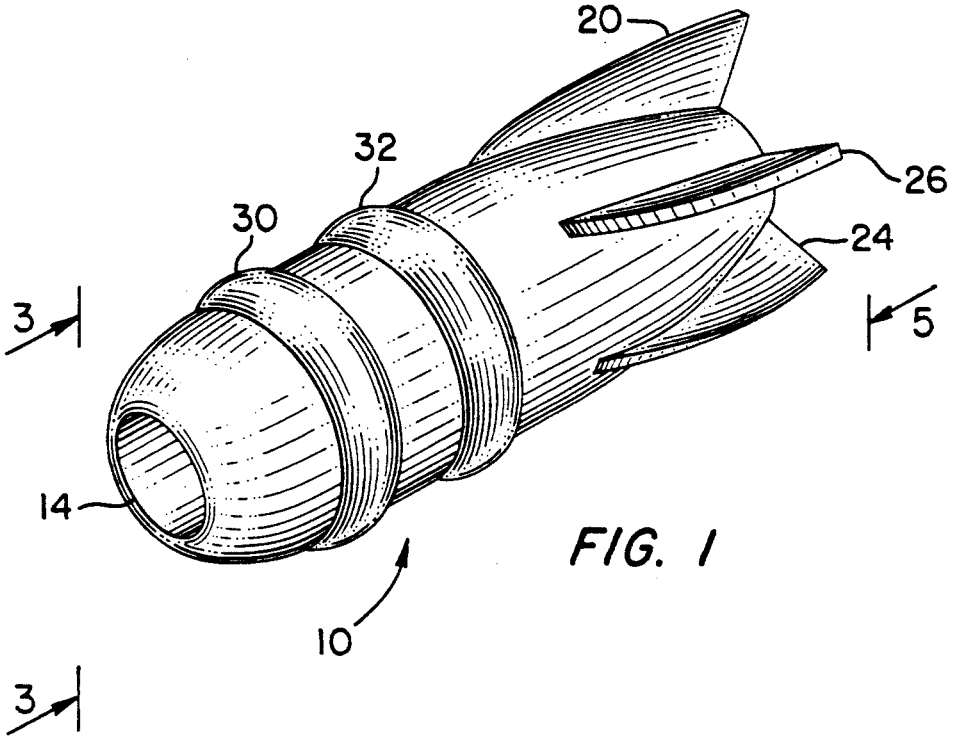
FIG. 1 is an overall perspective view of a toy with aerodynamic properties according to the present invention.

With reference to the drawings, there is shown in FIG. 1 a toy with aerodynamic properties 10 in accordance with the present invention which includes a body member 12 having a front end 14, a rear end 16 an inner cylindrical surface 18, a plurality of circumferentially spaced wings 20,22,24,26 which project from a portion 28 of the body member 12 proximate to the rear end 16 and a pair of circumferential bands 30,32.

The body member 12 has an outer surface 34 which is generally cylindrical and which is generally coaxial with the inner cylindrical surface 18. The outer surface 34 has a first curved portion 36 proximate to the front end 14, a cylindrical portion 38 and a tapered portion 40 proximate to the rear end 16. The first curved portion 36, the cylindrical portion 38, and the tapered portion 40 are blended to form a continuous surface which presents minimum air resistance.

The circumferentially spaced wings 20,22,24,26 extend from the portion 28 of the body member which is proximate to the rear end 16. Each of the wings 20,22,24,26 is defined by a curved upper edge 42 which has a front portion 44 which is close to the body member 12 and a straight rear edge 46 which projects upwardly and rearwardly and extends beyond the rear end 16 of the body member 12. The width of the wings 20,22,24,26 increases in a gradual manner from the relatively narrow front portion 48 of the wings 20,22,24,26 to the relatively wider rear portion 50 of the wings 20,22,24,26.

The orientation of the wings 20,22,24,26 relative to the body member 12 forms a novel feature of the present invention. Each of the wings 20,22,24,26 is mounted on the body member 12 so that when viewed from the rear end 16 of the body member 12 as in FIG. 5 the wings 20,22,24,26 project in a generally radial manner as will be more fully described below.

Figure 5:
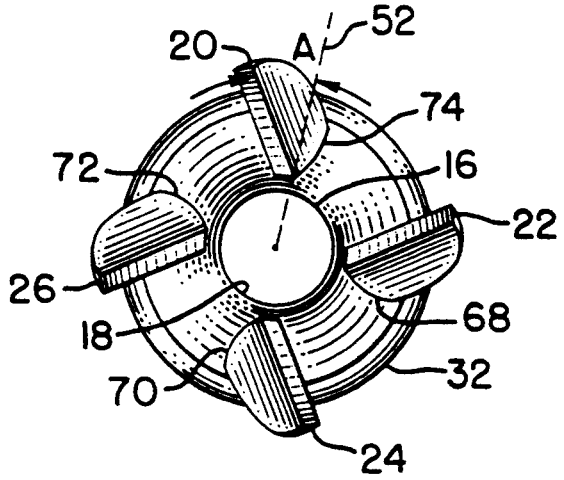
FIG. 5 is an end view of the rear end of the toy of FIG. 1 taken along the line 5—5 in FIG. 1.

As is shown in FIG. 5, the wings 20,22,24,26 are each inclined or rotated from a purely radial direction which is indicated for reference by the broken line 52 in FIG. 5. The angle of inclination of the wings 20,22,24,26 is indicated typically by the angle which is denoted by the letter A in FIG. 5.

Figure 2:
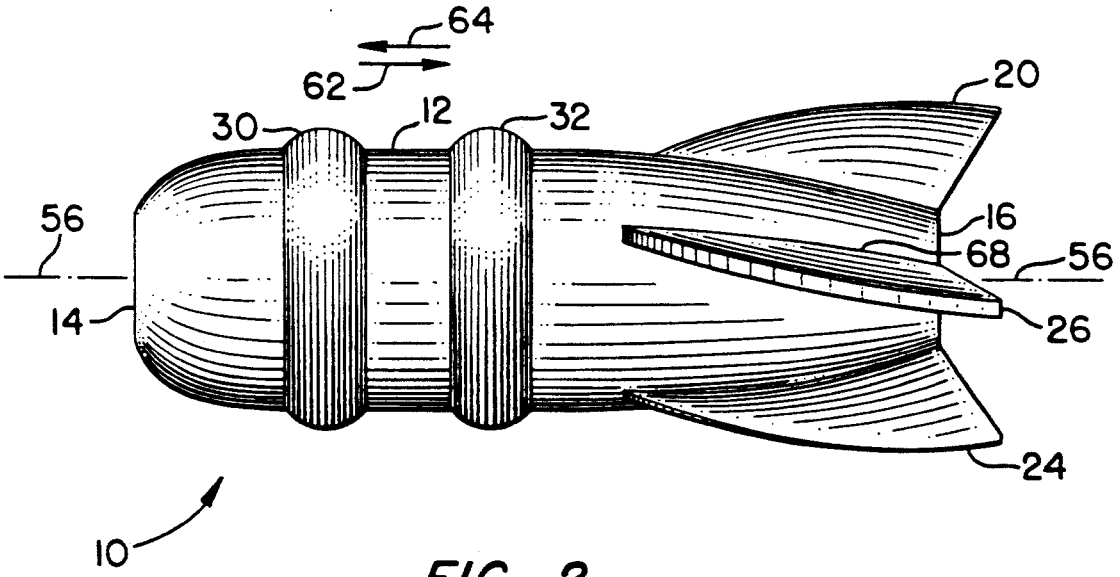
FIG. 2 is a side elevation view of the toy of FIG. 1.
Figure 3:
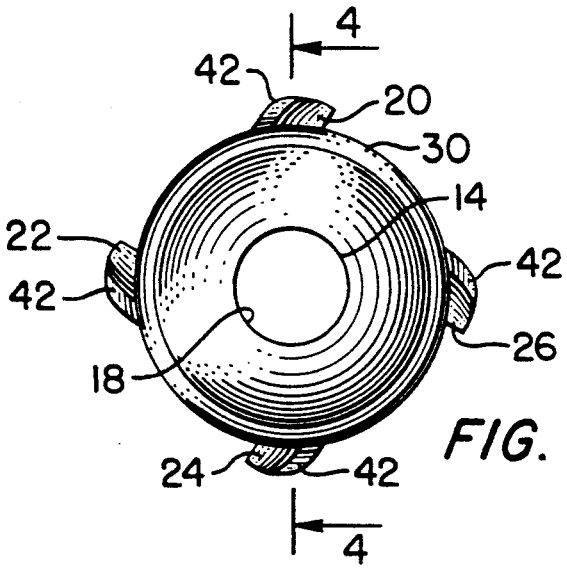
FIG. 3 is an end view of the front end of the toy of FIG. 1 taken along the line 3—3 in FIG. 1.
Figure 4:
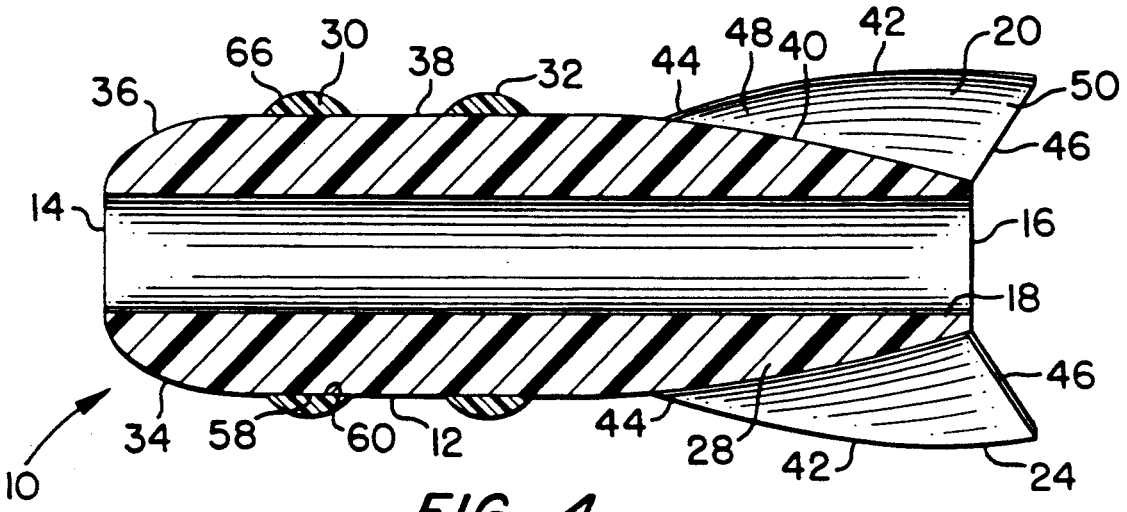
FIG. 4 is a cross-sectional view taken along the line 4—4 in FIG. 3.

In addition, the intersections between the wings 20,22,24,26 and the body member 12 each form a curved line which is shown most clearly by the curved intersection line 68 in FIG. 2 and the curved intersection lines 68,70,72,74 in FIG. 5. The mounting of the wings 20,22,24,26 on the body member 12 results in an overall spiral-like configuration of the wings 20,22,24,26 which facilitates spinning of the toy 10 around the longitudinal axis or center line 56 when thrown by a user. This spinning of the toy 10 provides a stabilizing effect on the flight path of the toy 10.

Each of the circumferential bands 30,32 is made of plastic and has an inner surface 58 which is flat and which abuts the surface 60 of the body member 12. The outer surface 66 of the circumferential bands 30,32 may be moved in the directions shown by the arrows 62,64 in FIG. 2 thereby easily adjusting the center of gravity of the toy 10 and making it possible to easily adjust the spacing between the bands 30,32 to facilitate the grasping and throwing of the toy 10 by users having different size hands.

The circumferential bands 30,32 are made of a solid moldable plastic and the body member 12 and the wings 20,22,24,26 are made of a plastic foam. The outer surface of the body member 12 is generally rough which facilitates throwing and catching the toy 10. The circumferential bands 30,32 provide a significant contribution toward the overall rotational inertia of the toy 10 since the relatively heavy material of the cylindrical bands 30,32 is spaced away from the center line 56 of the inner cylindrical surface 18. The combined effect of: the rotational inertia of the cylindrical bands 30,32, the rotational inertia of the body member 12, the cylindrical inner surface 18 which minimizes the air resistance to forward motion and the wings 20,22,24,26 which facilitate spiral motion of the toy 10 enables the toy 10 to be easily thrown by a user in a forwardly spiral manner. In flight, the toy 10 demonstrates a high degree of aerodynamic stability. The combined effect of the various elements described above each contribute toward the overall aerodynamic properties of the toy 10 and enhance the play value.

The foregoing specific embodiment of the present invention as set forth in the specification herein is for illustrative purposes only. Various changes and modifications may be made within the spirit and scope of this invention.

What is claimed is:

1. A cylindrical aerodynamic toy with ballast rings comprising a body member having a front and a rear end, an inner cylindrical surface in open communication with said front and rear end, an outer convexly curved surface coaxial with said inner cylindrical surface and said outer surface lying between said front end and said rear end and smoothly merging with said front end and a plurality of like wings spaced circumferentially from each other and extending toward said front end from said rear end.

2. A cylindrical aerodynamic toy with ballast rings according to claim 1 in which said circumferential ring is slidably mounted on said body member.

3. A cylindrical aerodynamic toy with ballast rings according to claim 1 in which said circumferential ring includes a rounded outer surface.

4. A cylindrical aerodynamic toy with ballast rings according to claim 1 in which said plurality of wings comprises four wings.

5. A cylindrical aerodynamic toy with ballast rings according to claim 1 in which said wings are disposed in a generally spiral relationship relative to said body member.

6. A cylindrical aerodynamic toy with ballast rings according to claim 1 in which said body member and said wings are made of a foam plastic.

7. A cylindrical aerodynamic toy with ballast rings according to claim 1 in which said circumferential ring is made of a solid plastic.

8. A cylindrical aerodynamic toy with ballast rings properties according to claim 1 in which said wings project rearwardly beyond said rear end of said body member.

9. A cylindrical aerodynamic toy with ballast rings according to claim 1 in which said body member includes a relatively rough outer surface.

* * * * *